US006679368B2

(12) United States Patent
Ishida et al.

(10) Patent No.: US 6,679,368 B2
(45) Date of Patent: Jan. 20, 2004

(54) MONEY HANDLING METHOD AND DEVICE

(75) Inventors: Takeshi Ishida, Tokyo (JP); Tsunehiro Aso, Tokyo (JP)

(73) Assignee: Kabushiki Kaisha Nippon Conlux, Tokyo (JP)

( * ) Notice: Subject to any disclaimer, the term of this patent is extended or adjusted under 35 U.S.C. 154(b) by 133 days.

(21) Appl. No.: 09/774,980

(22) Filed: Jan. 31, 2001

(65) Prior Publication Data

US 2001/0013456 A1 Aug. 16, 2001

(30) Foreign Application Priority Data

Feb. 15, 2000 (JP) ..... 2000-036704

(51) Int. Cl.[7] ..... G07F 9/00
(52) U.S. Cl. ..... 194/217; 194/302
(58) Field of Search ..... 194/206, 207, 194/217, 302; 209/534; 453/30, 32

(56) References Cited

U.S. PATENT DOCUMENTS

| | | | | | |
|---|---|---|---|---|---|
| 5,154,272 | A | * | 10/1992 | Nishiumi et al. | 194/217 |
| 5,201,424 | A | * | 4/1993 | Hain | 209/534 |
| 5,566,807 | A | * | 10/1996 | Morun | 194/217 |
| 5,590,790 | A | * | 1/1997 | Saunders | 209/534 |
| 6,040,584 | A | * | 3/2000 | Liu et al. | 250/559.11 |
| 6,109,416 | A | * | 8/2000 | Nickerson | 194/206 |

* cited by examiner

*Primary Examiner*—Dean J. Kramer
(74) *Attorney, Agent, or Firm*—Welsh & Katz, Ltd.

(57) ABSTRACT

A money handling method and device capable of automatically stopping the acceptance of old moneys depending on a circulating amount of old and new moneys. In a state that new and old moneys are judged as authentic and accepted by a coin type judgment unit, a switching condition decision unit compares an insertion state of new moneys with a condition stored in a condition value storage unit, and when the insertion state agrees with the stored condition, the coin type judgment unit returns the old moneys as counterfeit.

10 Claims, 8 Drawing Sheets

MONEY HANDLING METHOD AND DEVICE

BACKGROUND OF THE INVENTION

1. Field of the Invention

The present invention related to a money handling method and device, and more particularly to a money handling method and device which can easily switch handling of money between old and new.

2. Description of the Related Art

A coin handling device or a paper money handling device used in the automatic vending machines and the like accepts inserted coins when they are judged authentic by identifying them as authentic or counterfeit and denominations, and allows sales of a commodity, and if change must be dispensed, dispenses the appropriate coins.

A coin or paper money is sometimes replaced with one having a new design, namely a new coin or a new paper money, for various reasons.

Replacement with the new money (new coin or new paper money) does not mean that the existing money (old coin or old paper money) become unusable or is stopped its circulation immediately. In other words, the new money and the old money coexist for a certain period in which the coin handling device or the paper money handling device needs to handle both the new and old moneys. It is because if only one of the new money and the old money is handled during their coexisting period, users feel inconvenient, and the automatic vending machine sides will lose an opportunity of sales.

On the other hand, handling of both the new money and the old money may become complex in management. For example, when new money and old money are accepted in the same way, both the new and old moneys are dispensed as change. It is not desirable to do so after a lapse of predetermined period since the replacement of moneys, and when the new money and the old money are separately accepted, it means that the money types are increased and their handling becomes complex.

Therefore, when replacing the old money with the new money, it is desirable that a suitable period when both of them can be used is determined, and after a lapse of such a period, only the new money is handled.

As described above, it is desirable that the money handling device handles both the new money and the old money when the old one is replaced with the new one, and then the new money only is handled. However, when a conventional money handling device is switched from a mode of handling both the new money and the old money to a mode of handling the new money only, it was necessary to rewrite a program and to make other works, and such works were troublesome.

Besides, the circulation of new money involves a regional difference, and it was hard to switch the mode of handling both the new one and the old one to the mode handling the new one only all together.

SUMMARY OF THE INVENTION

Accordingly, it is an object of the present invention to provide a money handling method and device which can automatically stop the acceptance of old money depending on a circulating amount of new money and old money.

To achieve the above object of the invention, there is provided a money handling method to identify inserted old moneys and new moneys as authentic or counterfeit and denominations and to accept or return the old moneys and the new moneys, comprising: monitoring the inserted old moneys and new moneys, and stopping the acceptance of the old moneys when the inserting state of the old and new moneys agrees with a predetermined condition.

A further feature of the subject invention provides that wherein the predetermined condition is that the number of inserted new moneys has reached a predetermined number or more, and after agreeing with the predetermined condition, the old moneys are not accepted but returned.

A further feature of the subject invention provides that wherein the predetermined condition is that the number of new moneys inserted within a predetermined period has reached a predetermined number or more, and after agreeing with the predetermined condition, the old moneys are not accepted but returned.

A further feature of the subject invention provides that wherein the predetermined condition is that a ratio between the number of new moneys and that of old moneys inserted within a predetermined period has reached a predetermined value, and after agreeing with the predetermined condition, the old moneys are not accepted but returned.

A further feature of the subject invention provides that wherein the predetermined condition is that the number of money continuously inserted has exceeded a predetermined value, and after agreeing with the predetermined condition, the old moneys are not accepted but returned.

A further feature of the subject invention provides that wherein the accepted old moneys are recovered and prohibited from being dispensed.

A still further feature of the subject invention is a money handling device to identify inserted old moneys and new moneys as authentic or counterfeit and denominations and to accept or return the old moneys and the new moneys, comprising: money type judging means for identifying the inserted old moneys and new moneys as authentic or counterfeit and denominations; money storage means for storing money including at least the new moneys, which are identified as authentic by the money type judging means, by denominations; condition judgment means for judging whether a insertion state of the old and new moneys judged by the money type judgment means has reached a predetermined condition; and prohibition means for prohibiting the acceptance of the old moneys after the condition judgment means judged that the insertion state of the old moneys and the new moneys has agreed with the predetermined condition.

The prohibition means is realized so to instruct to return the old money upon determining it as counterfeit b the money types for example.

A still further feature of the subject invention is a prohibition means which comprises: counting means for counting the number of the inserted new moneys; and comparison means for comparing the inserted number of money counted by the counting means with a predetermined reference number of money; and the old moneys are not accepted but returned on condition that the comparison means judges that the number of inserted new moneys has reached the predetermined reference number of money.

A still further feature of the subject invention is a prohibition means which comprises: clocking means for clocking a predetermined period; counting means for counting the number of inserted new moneys; and comparison means for comparing the number of inserted moneys counted by the counting means with a predetermined reference number of money; and the old moneys are not accepted but returned on condition that the comparison means judged that the number of inserted new moneys has reached the predetermined reference number of money within the predetermined period clocked by the clocking means.

A still further feature of the subject invention is a prohibition means which comprises: clocking means for clocking a predetermined period; counting means for counting the number of inserted new moneys and the number of inserted old moneys; insertion number ratio calculation means for calculating a ratio between the number of new moneys and the number of old moneys counted by the counting means; and comparison means for comparing the ratio between the number of new coins and the number of old coins calculated by the insertion number ratio calculation means with a predetermined reference value; and the old moneys are not accepted but returned on condition that the comparison means judged that the ratio between the number of new moneys and the number of old moneys has reached the predetermined reference value within the predetermined period clocked by the clocking means.

A still further feature of the subject invention is a prohibition means which comprises: counting means for counting the number of continuously inserted new moneys; and comparison means for comparing the number of continuously inserted moneys counted by the counting means with a predetermined reference number of money; and the old moneys are not accepted but returned on condition that the comparison means judged that the number of continuously inserted new moneys has reached the predetermined reference number of money.

A still further feature of the subject invention is a money recovery means for recovering the accepted moneys without storing them in the storage means, wherein the money recovery means recovers the old moneys judged by the coin type judgment means and prohibit them from being dispensed.

According to the present invention, when the state of inserting the new money agrees with the predetermined condition in the state that the new money and the old money are being accepted, the acceptance of the old one is stopped, so that the acceptance of the old money can be stopped depending on the circulating state of the new money, which is different in respective regions, without making a setting change involving complex work.

DESCRIPTION OF THE PREFERRED EMBODIMENTS

One embodiment of the money handling method and device to which the invention pertains will be described with reference to the accompanying drawings.

Figure 1:
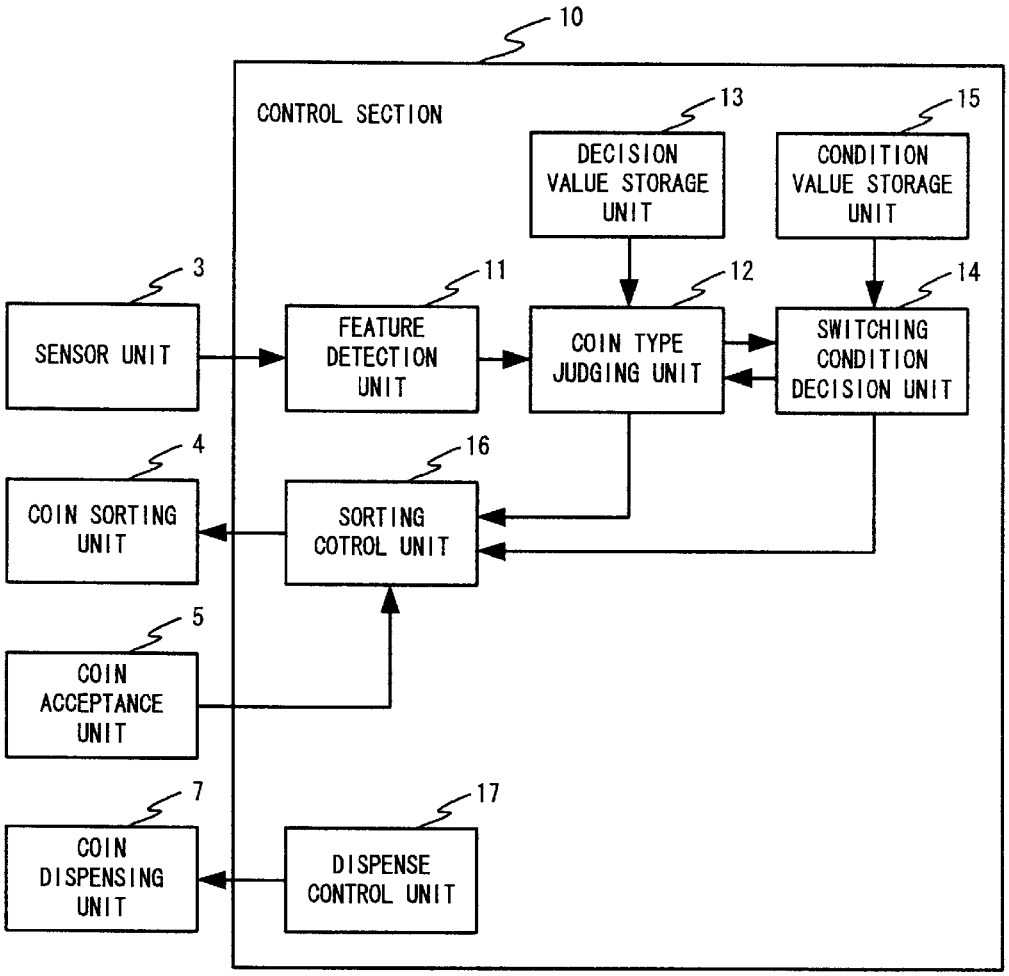
FIG. 1 is a block diagram showing the structure of a coin handling device which is one of the money handling device according to the invention.
Figure 2:
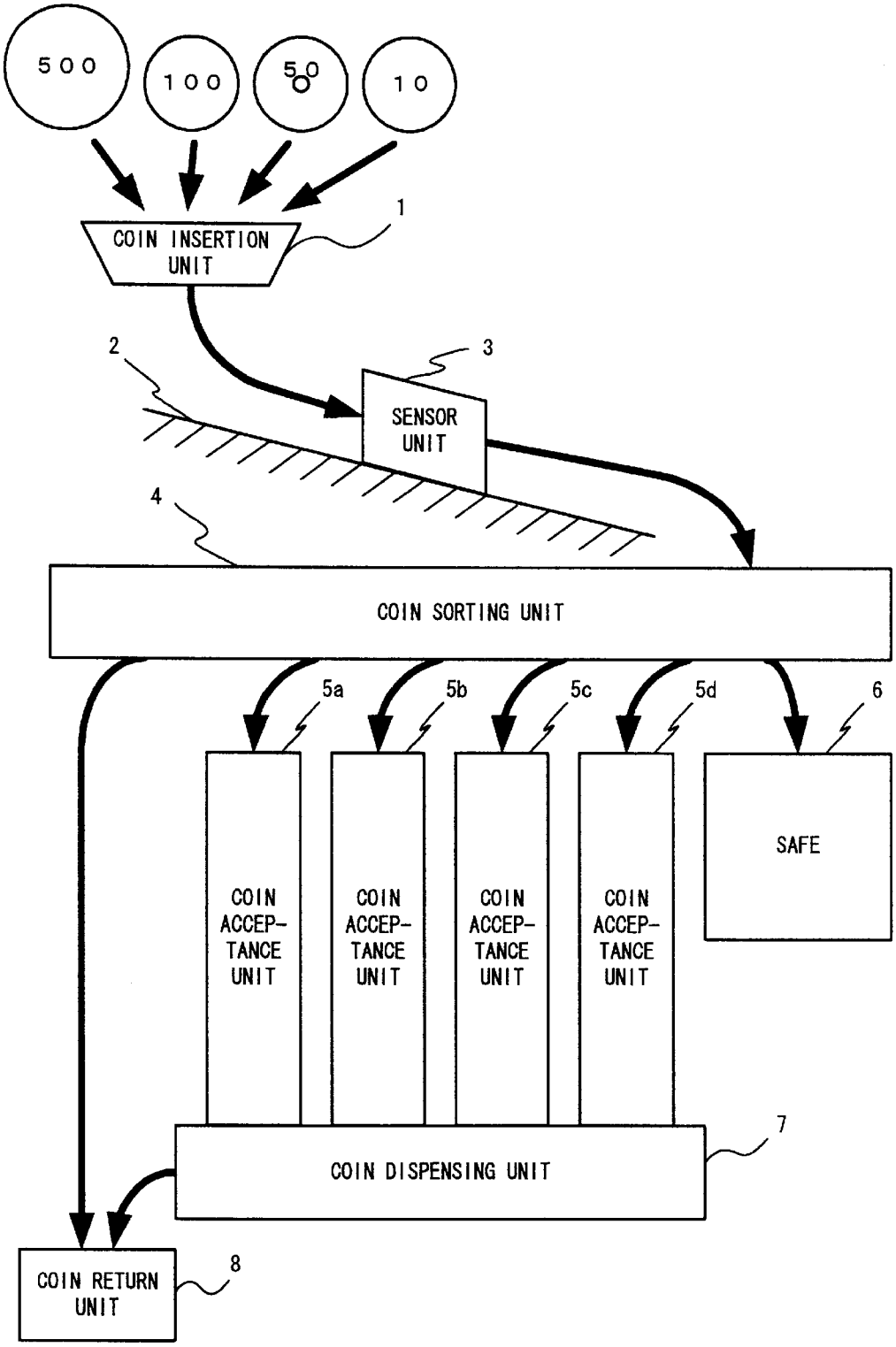
FIG. 2 is a schematic diagram showing a flow of coins in the coin handling device.

FIG. 1 is a block diagram showing a structure of the coin handling device which is one of the money handling device according to the present invention, and FIG. 2 is a schematic diagram showing a flow of a coin in the coin handling device.

The coin handling device comprises coin insertion unit 1, coin passage 2, sensor unit 3, coin sorting unit 4, coin acceptance unit 5 (5*a*, 5*b*, 5*c*, 5*d*), safe 6, coin dispensing unit 7, coin return unit 8 and control section 10.

A coin inserted through the coin insertion unit 1 rolls through the coin passage 2 and is detected its features by the sensor unit 3. The control section 10 identifies the coin as authentic or counterfeit and its denomination according to the features of the coin and controls the coin sorting unit 4. The coin sorting unit 4 sorts the coin according to the control by the control section 10 into the coin reception unit 5, the safe 6 or the coin return unit 8. The coin sorted to the coin return unit 8 is a coin judged as counterfeit by the control section 10. And, the coin dispense unit 7 dispenses a coin stored in the coin reception unit 5 to the coin return unit 8 according to the control by the control section 10.

The control section 10 will be described below.

The control section 10 comprises feature detection unit 11, coin type judging unit 12, decision value storage unit 13, switching condition decision unit 14, condition value storage unit 15, sorting control unit 16, and dispense control unit 17.

The feature detection unit 11 detects the features of the inserted coin according to the output from the sensor unit 3, and the coin type judgment unit 12 judges the authentic or counterfeit and type of the coin based on the features detected by the feature detection unit 11 and the decision value stored in the decision value storage unit 13. The switching condition decision unit 14 judges a stop of the reception of the old coin or the like based on the results judged by the coin type judgment unit 12 and the condition values stored in the condition value storage unit 15. Details of the switching condition decision unit 14 will be described later in the specification.

The sorting control unit 16 sorts the inserted coin to the coin acceptance unit 5 or the coin return unit 8 based on the results judged by the coin type judgment unit 12 but when it receives a signal from the coin acceptance unit 5 that it is filled to capacity, sorts the inserted coin to the safe 6 instead of the coin acceptance unit 5. The dispense control unit 17 controls the coin dispense unit 7 to return the coin or dispense change based on the instruction from the control unit of an unshown automatic vending machine or the like.

The respective portions of the control section 10 are actually CPU, a memory and the like and operated according to programs.

The switching condition decision unit 14 will be described below.

The switching condition decision unit 14 controls to switch the subject coin to be received by the coin handling device when the old coin is replaced with the new coin. It decides a stop of the acceptance of the old coin and instructs it to the coin type judgment unit 12 according to a state of receiving the new and old coins by the coin type judgment unit 12 and the switching conditions stored in the condition value storage unit 15. When the acceptance of the old coin is stopped, the coin type judgment unit 12 determines the old coin as counterfeit and informs it to the sorting control unit 16.

Then, an operation of the coin handling device at switching from the old coin to the new coin will be described below.

Figure 3:
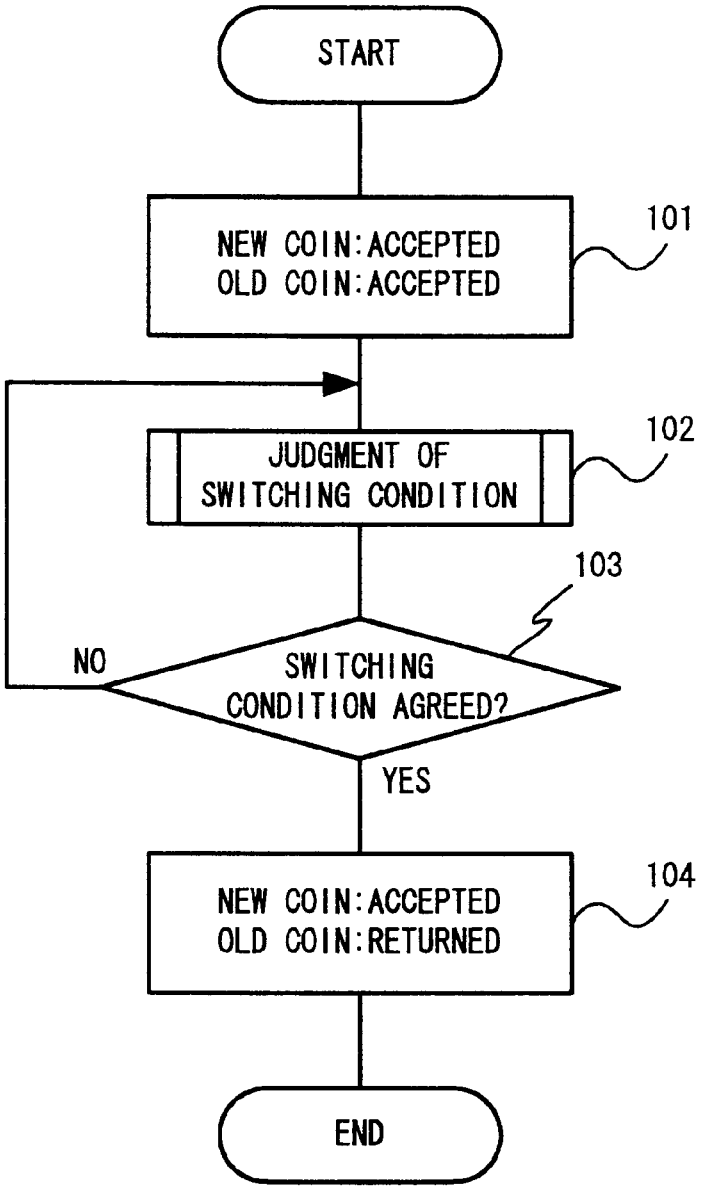
FIG. 3 is a flow chart (1) showing a flow of operation of the coin handling device at switching from old coins to new coins.

FIG. 3 is a flow chart showing a flow of the operation of the coin handling device when switching from the old coin to the new coin.

First, when the circulation of the new coin is started, the coin handling device accepts both the new and old coins (step 101). The coin handling device operated in the above state, and the switching condition decision unit 14 decides the switching conditions to be described later in the specification (step 102). When the judged result does not agree with the switching conditions (NO in step 103), the coin handling device continues its operation, and when the judged result agrees with the switching conditions (YES in step 103), the coin handling device accepts the new coin and operates to return the old coin (step 104) and terminates the switching process.

Here, a specific example of the decision of switch conditions by the switching condition decision unit 14 will be described. Though various switching conditions to be decided by the switching condition decision unit 14 are conceived, and three examples will be described below. A first example decides a switching time according to the number of accepting new coins in a predetermined period, a second example decides a switching time according to a ratio of accepting new and old coins in a predetermined period, and a third example decides a switching time according to the number of successively inserted new coins.

Figure 4:
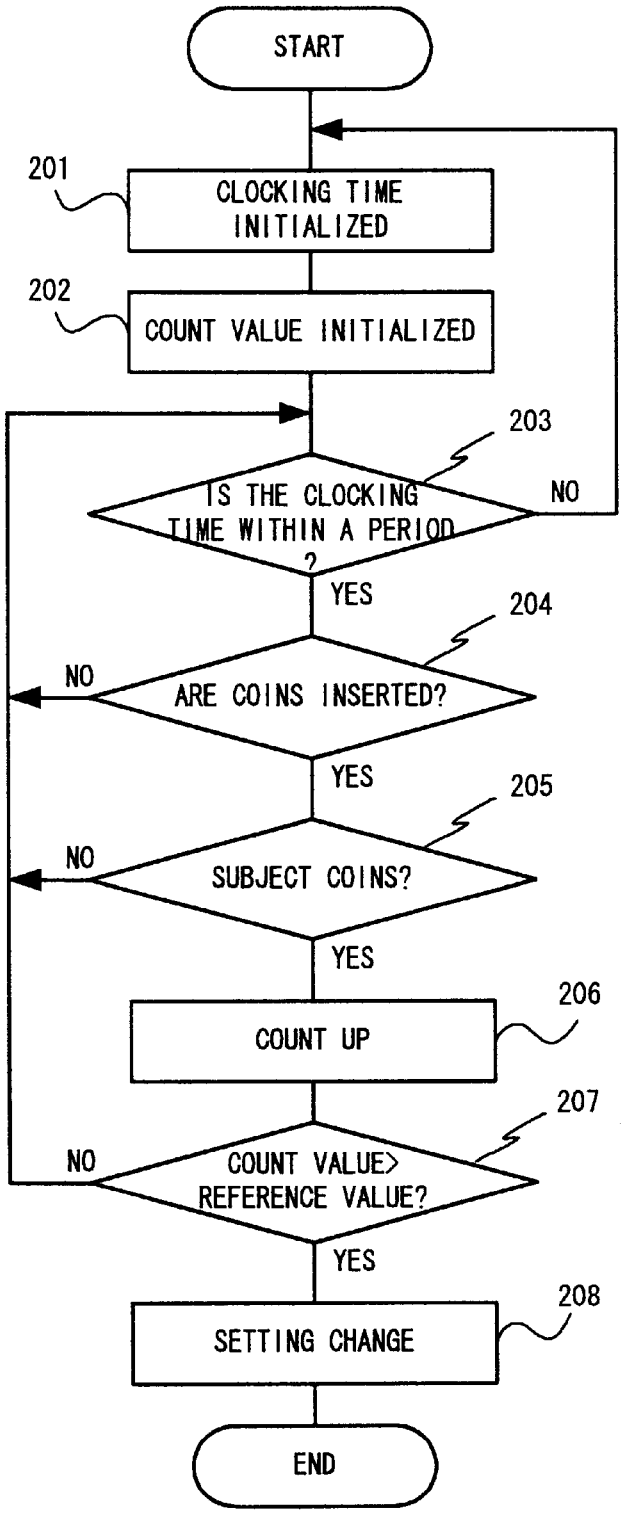
FIG. 4 is a flow chart (1) showing a flow of judging operation of switching condition decision unit 14.
Figure 5:
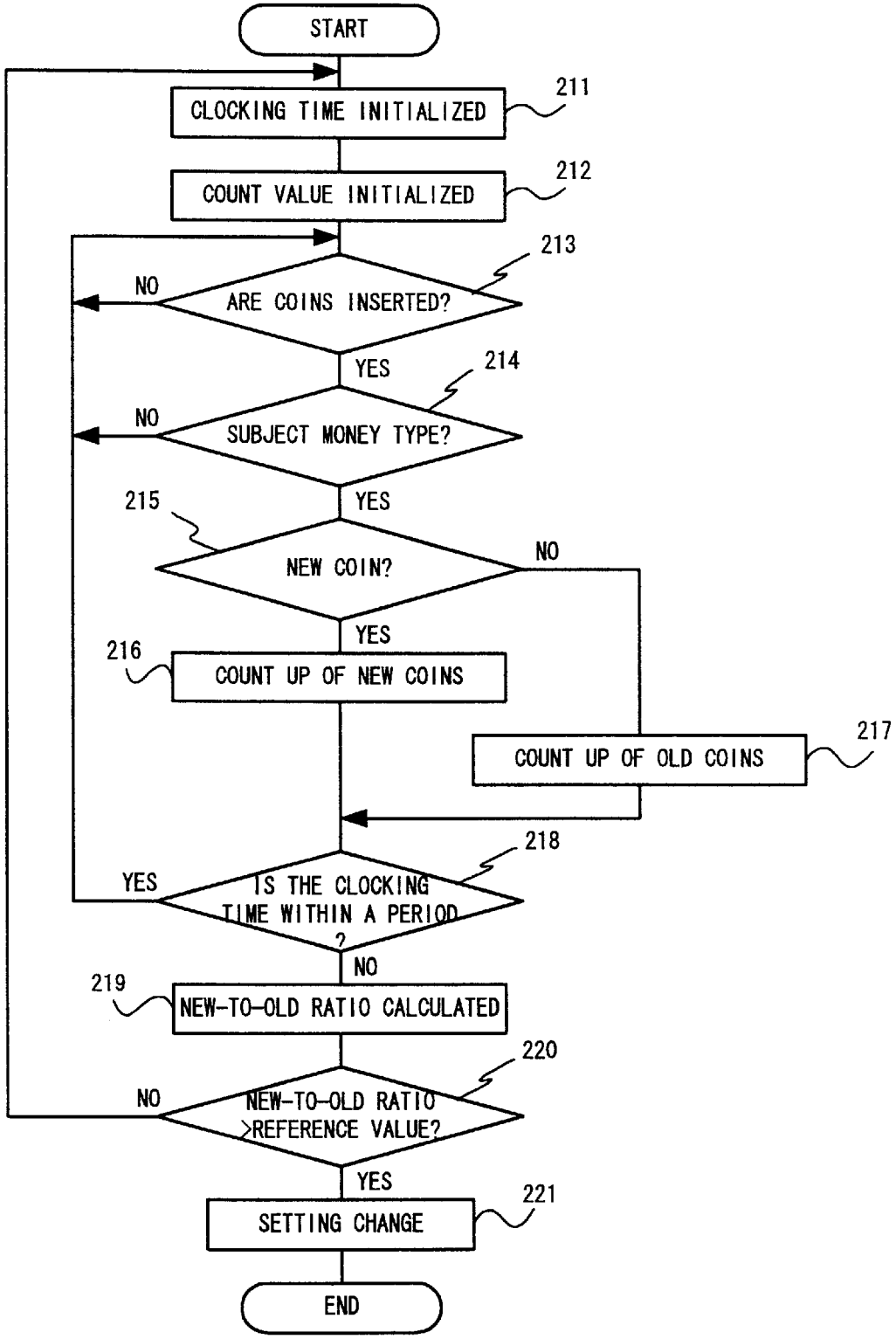
FIG. 5 is a flow chart (2) showing a flow of judging operation of the switching condition decision unit 14.
Figure 6:
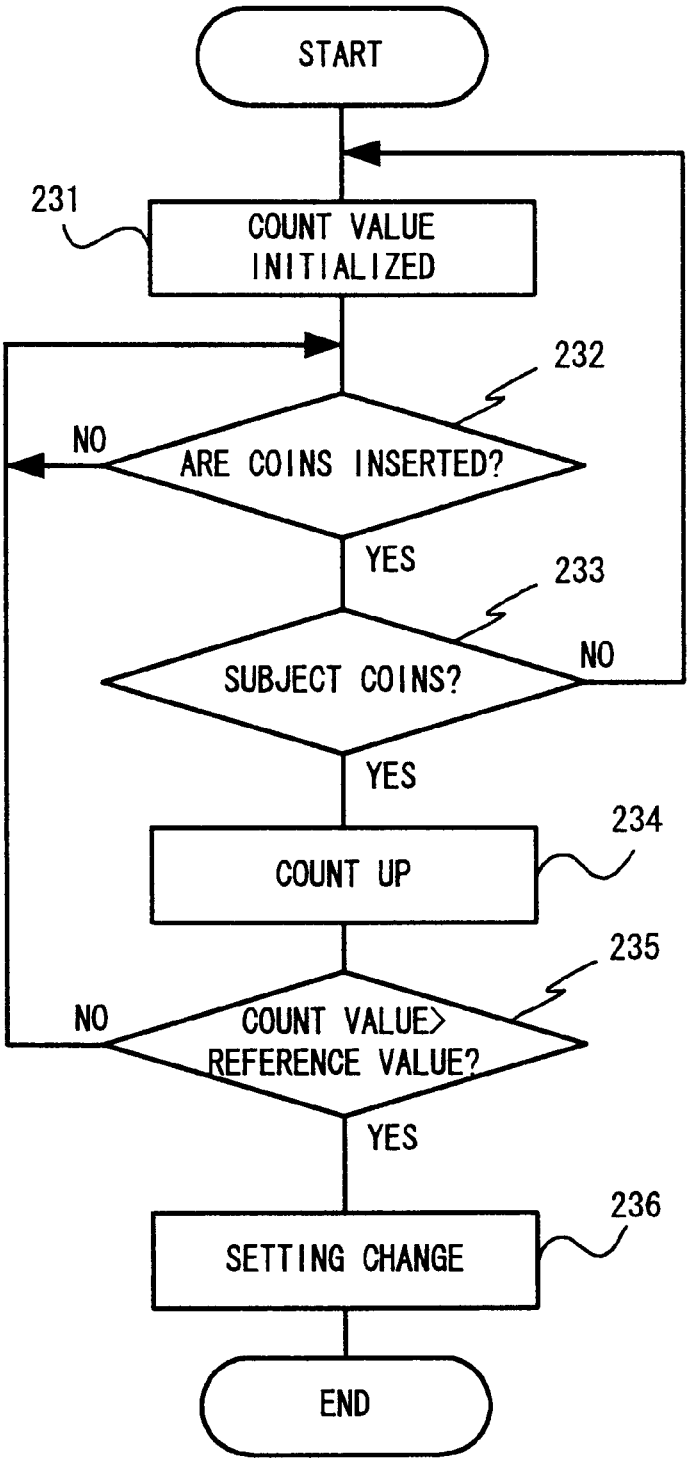
FIG. 6 is a flow chart (3) showing a flow of judging operation of the switching condition decision unit 14.

FIGS. 4 to 6 are flow charts showing a flow of judging operation of the switching condition decision unit 14.

In the first example, the switching condition decision unit 14 starts its operation, when clocking time to count a predetermined period is initialized (step 201), a counting value to count the number of accepted new coins is initialized (step 202), and clocking is started as shown in FIG. 4.

Subsequently, when the clocked time has not passed the predetermined period (a value stored in the condition value storage unit 15, e.g., one day) (YES in step 203) but coins are inserted (YES in step 204) and they are subject new coins (YES in step 205), the count value of the new coins is counted up (step 206). When the count value does not exceed a predetermined reference value (a value stored in the condition value storage unit 15), the process returns to step 203 to wait for another coin inserted. If the clocked time has passed a predetermined period while waiting for the insertion of another coin, the process returns to step 201, and the clocked time and the count value are initialized.

When the count value counted upon the insertion of the new coins exceeds the reference value (YES in step 207), the switching condition decision unit 14 judges that the switching condition is met (step 208), informs it to the coin type judgment unit 12 to stop the acceptance of the old coin and terminates the operation.

Thus, in the first example, when the new coins of the predetermined number or more are inserted in the predetermined period, it is judged that it is time enough to stop the acceptance of the old coin. In step 207, even when the count value exceeds the reference value, a setting change of step 208 is made after the vending operation is terminated if the automatic vending machine is operating, namely if there is a possibility that the same type of coins are continuously inserted. It may be designed to compare the count value with the reference value only when the clocked time has exceeded the predetermined time without comparing every count value of the new coins with the reference value.

As a modification of the above example, a situation that the new coins of the predetermined number or more are inserted without clocking may be determined as a switching condition.

The second example will be described below.

In the second example, when the switching condition decision unit 14 starts its operation, clocking time to count a predetermined period is initialized (step 211), a counting value to count the number of accepted new and old coins is initialized (step 212), and clocking is started as shown in FIG. 5.

Subsequently, when coins are inserted (YES in step 213) and the inserted coins are a mixture of the subject new and old coins (YES in step 214), and if the inserted coins are new coins (YES in step 215), the count value of the new coins is counted up (step 216), and if the inserted coins are old coins (NO in step 215), the count value of the old coins is counted up (step 217).

The count-up at the insertion of the subject type of coins is repeated while the clocking time is a predetermined period (a value stored in the condition value storage unit 15, e.g., one day) (YES in step 218). And, when the clocked time has passed a predetermined period (NO in step 218), a ratio between the number of counted new coins and the number of counted old coins is calculated (step 219).

Then, the calculated ratio between the new coins and the old coins is compared with a predetermined reference value (a value stored in the condition value storage unit 15) (step 220), and when the new-to-old ratio does not exceed the reference value (NO in step 220), the process returns to step 211, and the clocking time and the count value are initiated; and if the new-to-old ratio exceeds the reference value (YES in step 220), the switching condition decision unit 14 judges that the switching condition is met (step 221), informs it to the coin type judgment unit 12 to stop the acceptance of the old coins and terminates the operation.

Thus, in the second example, when the number of new coins inserted in the predetermined period is larger than the predetermined number as compared with the number of old coins inserted in the same period, it is judged that it is time enough to stop the acceptance of the old coins.

Then, the third example will be described below.

In the third example, when the switching condition decision unit 14 starts its operation, a counting value to count the number of accepted new coins is initialized (step 231) as shown in FIG. 6.

Then, the insertion of coins is waited (NO in step 232), when the coins are inserted (YES in step 232) and they are new coins to be counted (YES in step 233), the count value is counted up (step 234), and the count value is compared with a predetermined reference value (a value stored in the condition value storage unit 15) (step 235).

When the compared result indicates that the count value does not exceed the reference value (NO in step 235), the process returns to step 232 to wait for the next insertion of a coin or coins. When the inserted coin is not the subject coin, namely the new coin (NO in step 233), the process returns to step 231, and the count value is initialized.

On the other hand, when the counted value of the new coins exceeds the reference value (YES in step 235), the switching condition decision unit 14 judges that the switching condition is met (step 236), informs it to the coin type judgment unit 12 to stop the acceptance of the old coin and terminates the operation.

Thus, in the third example, when the subject new coins are continuously inserted in the predetermined number or more, it is judged that it is time enough to stop the acceptance of the old coin.

The coin handling device described above was handling the new coins and the old coins in the same way before the switching condition is met as shown in FIG. 3. But, the old coins shall not be circulated continuously and must be recovered quickly. Therefore, the coin handling device can sort the old coins not to the coin reception unit 5 but to the safe 6 so to positively collect them.

Figure 7:
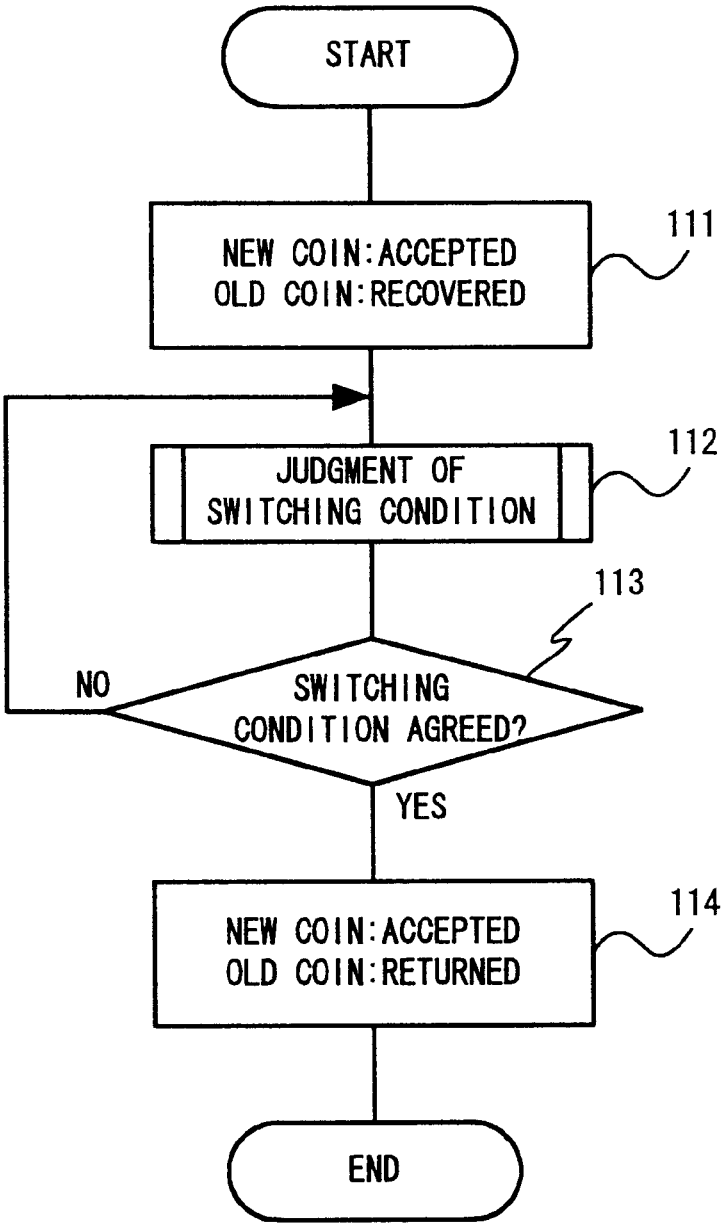
FIG. 7 is a flow chart (2) showing a flow of operation of the coin handling device at switching from old coins to new coins.

For example, it is shown in FIG. 7 that it may be designed that when the new coins are started their circulation, the coin handling device accepts the new coins and recovers the old coins (step 111); and according to the judgment by the switching condition decision unit 14 (step 112), when the switching condition is not met (NO in step 103), the coin handling device continues its operation, and when the switching condition is met (YES in step 103), the coin handling device accepts the new coins but returns the old coins (step 104) and then terminates the switching operation.

Figure 8:
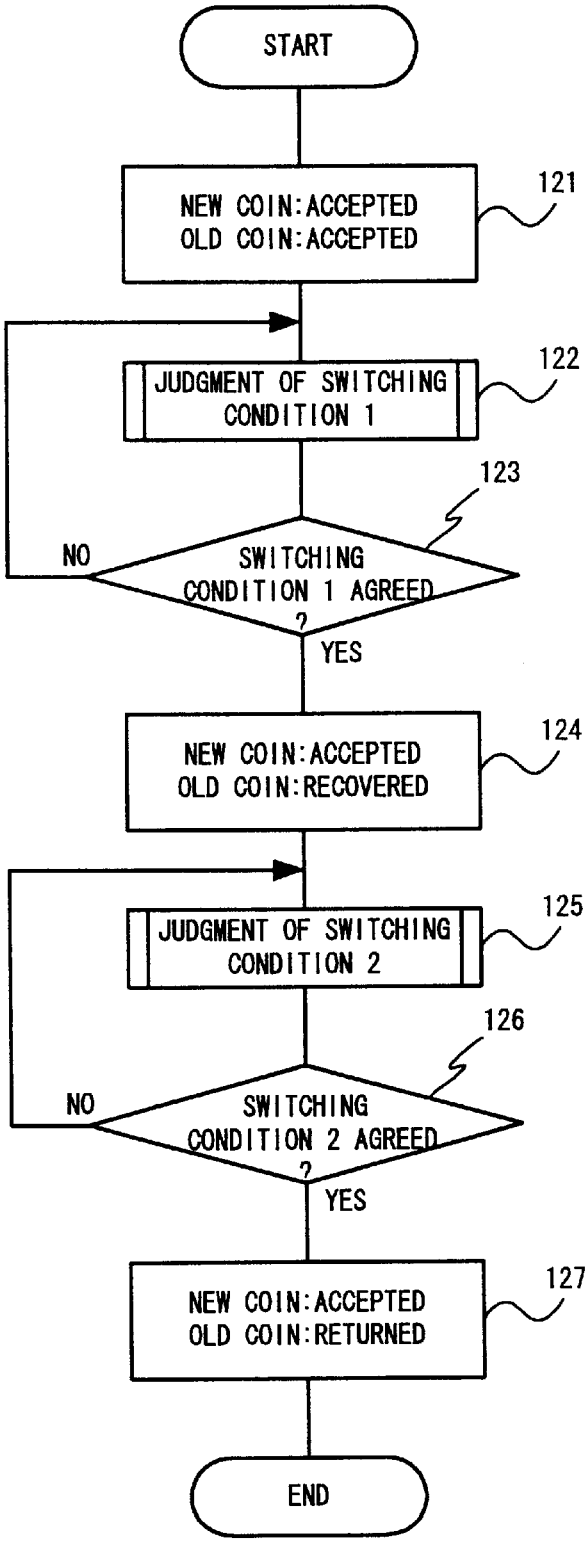
FIG. 8 is a flow chart (3) showing a flow of operation of the coin handling device at switching from old coins to new coins.

It may be designed not to recover the old coins immediately but to recover and return them in stages as shown in FIG. 8.

The coin handling device first accepts both the new coins and the old coins (step 121) in the operation shown in FIG. 8. The coin handling device operates in the above state, and the switching condition decision unit 14 judges switching condition 1 (step 122), and when the switching condition 1 is met (YES in step 123), operates to accept the new coins and recover the old coins (step 124).

Then, the coin handling device continues to operate and the switching condition decision unit 14 judges switching condition 2 (step 125), and when it agrees with the switching condition 2 (YES in step 126), operates to accept the new coin and to return the old coins (step 127) and terminates the switching operation.

The switching condition 1 and the switching condition 2 judged by the switching condition decision unit 14 are the same as those described with reference to FIGS. 4 to 6 and may be designed to have a different period and reference value or may use the same period and reference value.

In the above description, the coin handling device was referred to, but the same switching process can also be applied for the paper money handling device, and the invention can be applied to the money handling devices in general (including the coin handling device and the paper money handling device).

What is claimed is:

1. A money handling method to identify a first moneys having old designs and second moneys having new designs inserted by a user as authentic or counterfeit and denominations and to accept or return the first moneys and the second moneys to the user, comprising:

monitoring the inserted first moneys and second moneys, and returning the first moneys to the user without accepting them when the inserting state of the first and second moneys agrees with a predetermined condition, wherein the predetermined condition is that the number of inserted second moneys has reached a predetermined number or more, and after agreeing with the predetermined condition, the first moneys are not accepted but returned.

2. A money handling method to identify a first moneys having old designs and second moneys having new designs inserted by a user as authentic or counterfeit and denominations and to accept or return the first moneys and the second moneys to the user, comprising:

monitoring the inserted first moneys and second moneys, and returning the first moneys to the user without accepting them when the inserting state of the first and second moneys agrees with a predetermined condition, wherein the predetermined condition is that the number of second moneys inserted within a predetermined period has reached a predetermined number or more, and after agreeing with the predetermined condition, the first moneys are not accepted but returned.

3. A money handling method to identify a first moneys having old designs and second moneys having new designs inserted by a user as authentic or counterfeit and denominations and to accept or return the first moneys and the second moneys to the user, comprising:

monitoring the inserted first moneys and second moneys, and returning the first moneys to the user without accepting them when the inserting state of the first and second moneys agrees with a predetermined condition, wherein the predetermined condition is that a ratio between the number of second moneys and that of first moneys inserted within a predetermined period has reached a predetermined value, and after agreeing with the predetermined condition, the first moneys are not accepted but returned.

4. A money handling method to identify a first moneys having old designs and second moneys having new designs inserted by a user as authentic or counterfeit and denominations and to accept or return the first moneys and the second moneys to the user, comprising:

monitoring the inserted first moneys and second moneys, and returning the first moneys to the user without accepting them when the inserting state of the first and second moneys agrees with a predetermined condition, wherein the predetermined condition is that the number of money continuously inserted has exceeded a predetermined value, and after agreeing with the predetermined condition, the first moneys are not accepted but returned.

5. A money handling method to identify a first moneys having old designs and second moneys having new designs inserted by a user as authentic or counterfeit and denominations and to accept or return the first moneys and the second moneys to the user, comprising:

monitoring the inserted first moneys and second moneys, and returning the first moneys to the user without accepting them when the inserting state of the first and second moneys agrees with a predetermined condition, wherein the accepted first moneys are recovered and prohibited from being dispensed.

6. A money handling device to identify a first moneys having old designs and second moneys having new designs inserted by a user as authentic or counterfeit and denominations and to accept or return the first moneys and the second moneys to the user, comprising:

money type judging means for identifying the inserted first moneys and second moneys as authentic or counterfeit and denominations;

money storage means for storing money including at least the second moneys, which are identified as authentic by the money type judging means, by denominations;

condition judgment means for judging whether a insertion state of the first and second moneys judged by the money type judgment means has reached a predetermined condition; and prohibition means for returning the first moneys to the user without accepting the first money after the condition judgment means judged that the insertion state of the first moneys and the second moneys has agreed with the predetermined condition, wherein the prohibition means comprises:

counting means for counting the number of the inserted second moneys; and comparison means for comparing the inserted number of money counted by the counting means with a predetermined reference number of money; and the first moneys are not accepted but returned on condition that the comparison means judges that the number of inserted second moneys has reached the predetermined reference number of money.

7. A money handling device to identify a first moneys having old designs and second moneys having new designs inserted by a user as authentic or counterfeit and denominations and to accept or return the first moneys and the second moneys to the user, comprising:

money type judging means for identifying the inserted first moneys and second moneys as authentic or counterfeit and denominations;

money storage means for storing money including at least the second moneys, which are identified as authentic by the money type judging means, by denominations;

condition judgment means for judging whether a insertion state of the first and second moneys judged by the money type judgment means has reached a predetermined condition; and prohibition means for returning the first moneys to the user without accepting the first money after the condition judgment means judged that the insertion state of the first moneys and the second moneys has agreed with the predetermined condition, wherein the prohibition means comprises:

clocking means for clocking a predetermined period;

counting means for counting the number of inserted second moneys; and comparison means for comparing the number of inserted moneys counted by the counting means with a predetermined reference number of money; and the first moneys are not accepted but returned on condition that the comparison means judged that the number of inserted second moneys has reached the predetermined reference number of money within the predetermined period clocked by the clocking means.

8. A money handling device to identify a first moneys having old designs and second moneys having new designs inserted by a user as authentic or counterfeit and denominations and to accept or return the first moneys and the second moneys to the user, comprising:

money type judging means for identifying the inserted first moneys and second moneys as authentic or counterfeit and denominations;

money storage means for storing money including at least the second moneys, which are identified as authentic by the money type judging means, by denominations;

condition judgment means for judging whether a insertion state of the first and second moneys judged by the money type judgment means has reached a predetermined condition; and prohibition means for returning the first moneys to the user without accepting the first money after the condition judgment means judged that the insertion state of the first moneys and the second moneys has agreed with the predetermined condition, wherein the prohibition means comprises:

clocking means for clocking a predetermined period;

counting means for counting the number of inserted second moneys and the number of inserted first moneys;

insertion number ratio calculation means for calculating a ratio between the number of second moneys and the number of first moneys counted by the counting means; and comparison means for comparing the ratio between the number of second coins and the number of first coins calculated by the insertion number ratio calculation means with a predetermined reference value; and the first moneys are not accepted but returned on condition that the comparison means judged that the ratio between the number of second moneys and the number of first moneys has reached the predetermined reference value within the predetermined period clocked by the clocking means.

9. A money handling device to identify a first moneys having old designs and second moneys having new designs inserted by a user as authentic or counterfeit and denominations and to accept or return the first moneys and the second moneys to the user, comprising:

money type judging means for identifying the inserted first moneys and second moneys as authentic or counterfeit and denominations;

money storage means for storing money including at least the second moneys, which are identified as authentic by the money type judging means, by denominations;

condition judgment means for judging whether a insertion state of the first and second moneys judged by the money type judgment means has reached a predetermined condition; and prohibition means for returning the first moneys to the user without accepting the first money after the condition judgment means judged that the insertion state of the first moneys and the second moneys has agreed with the predetermined condition, wherein the prohibition means comprises:

counting means for counting the number of continuously inserted second moneys; and comparison means for comparing the number of continuously inserted moneys counted by the counting means with a predetermined reference number of money; and the first moneys are not accepted but returned on condition that the comparison means judged that the number of continuously inserted second moneys has reached the predetermined reference number of money.

10. A money handling device to identify a first moneys having old designs and second moneys having new designs inserted by a user as authentic or counterfeit and denominations and to accept or return the first moneys and the second moneys to the user, comprising:

money type judging means for identifying the inserted first moneys and second moneys as authentic or counterfeit and denominations;

money storage means for storing money including at least the second moneys, which are identified as authentic by the money type judging means, by denominations;

condition judgment means for judging whether a insertion state of the first and second moneys judged by the money type judgment means has reached a predetermined condition; and prohibition means for returning the first moneys to the user without accepting the first money after the condition judgment means judged that the insertion state of the first moneys and the second moneys has agreed with the predetermined condition and further including money recovery means for recovering the accepted moneys without storing them in the storage means, wherein the money recovery means recovers the first moneys judged by the coin type judgment means and prohibit them from being dispensed.

* * * * *